US005167526A

United States Patent [19]

Pinyan et al.

[11] Patent Number: 5,167,526

[45] Date of Patent: Dec. 1, 1992

[54] ELECTRICAL CONNECTION DEVICE AND TELECOMMUNICATIONS TERMINAL BLOCK METHOD OF MANUFACTURING THE DEVICE AND BLOCK

[75] Inventors: James A. Pinyan, Apex; Michael E. Grice, Cary; Roy K. Thompson, Cary, all of N.C.; Marc Moisson, San Carlos, Calif.; Emanuele Scalco; Erwin De Bruycker, both of Cary, N.C.; Thomas M. Wilson, Sanford, N.C.; Jan Vansant, Leuven, Belgium; Geert Swinnen, Langdorp, Belgium; Annie Lequesne, Keerbergen, Belgium

[73] Assignee: Raychem Corporation, Menlo Park, Calif.

[21] Appl. No.: 586,361

[22] Filed: Sep. 21, 1990

[30] Foreign Application Priority Data

Sep. 21, 1989 [GB] United Kingdom ..... 8921316

[51] Int. Cl.[5] ..... H01R 4/24

[52] U.S. Cl. ..... 439/411; 439/416

[58] Field of Search ..... 439/409–419, 439/727, 728, 790–797

[56] References Cited

U.S. PATENT DOCUMENTS

| | | | |
|---|---|---|---|
| 2,078,825 | 4/1937 | Wisner | 439/412 |
| 3,546,660 | 12/1970 | Wilhelm et al. | 439/413 |
| 3,877,773 | 4/1975 | Doty et al. | 439/413 |
| 4,103,984 | 8/1978 | Mixon, Jr. | 439/415 |
| 4,365,861 | 12/1982 | Gore | 339/202 |
| 4,427,252 | 1/1984 | Lee et al. | 339/89 |
| 4,669,806 | 6/1987 | Fuchs | 439/813 |
| 4,734,061 | 3/1988 | Randall, Jr. et al. | 439/271 |
| 4,911,655 | 3/1990 | Pinyan et al. | 439/412 |
| 4,971,573 | 11/1990 | Pinyan | 439/412 |

FOREIGN PATENT DOCUMENTS

| | | | |
|---|---|---|---|
| 0298713 | 1/1989 | European Pat. Off. . | |
| 1173759 | 3/1959 | France | 439/813 |
| 299642 | 11/1928 | United Kingdom . | |
| 618755 | 2/1949 | United Kingdom . | |
| 1565519 | 4/1980 | United Kingdom . | |

*Primary Examiner*—David L. Pirlot

*Attorney, Agent, or Firm*—Herbert G. Burkard; William D. Zahrt, II; A. Stephen Zavell

[57] ABSTRACT

The invention comprises a telecommunications terminal block with integral but separate test port captured cap feature as well as a method of manufacturing same in an automated fashion. The block permits the electric connection of various size gauges of wires without the severing of the smallest gauges of wire or ruining the block when initially contacting on the largest gauge wire.

19 Claims, 9 Drawing Sheets

ELECTRICAL CONNECTION DEVICE AND TELECOMMUNICATIONS TERMINAL BLOCK METHOD OF MANUFACTURING THE DEVICE AND BLOCK

The invention relates to an electrical terminal blocks and means for electrically connecting wires. More specifically, the invention relates to a telecommunications terminal block useful for forming electrical contacts to a multiplicity of different gauged telecommunications drop wires.

The invention may incorporate any one or more of the features disclosed in EP 0298713 (Raychem) published Jan. 11, 1989, equivalent to U.S. Ser. Nos. 07/070,475 filed Jul. 7, 1987; 07/102,072 filed Sep. 29, 1987; and 07/130,347 filed Dec. 8, 1987 and also 07/270,411 filed Nov. 7, 1988, as well as the specification of GB 8921316.9 filed Sep. 21, 1989, the disclosures of each of which are completely incorporated herein by reference for all purposes.

BACKGROUND OF THE INVENTION

Many electrical connection blocks, and specifically telecommunications terminal blocks, require the stripping of the wire and the bending of the wire in a C-shape to be positioned on a terminal post either between washers or between a nut and the terminal base. With limited amounts of room this could be difficult work in warm weather and uncomfortable for the crafts person in cold weather. The process is time consuming and corrosion could affect the terminal and the connection.

To combat these problems, terminals called insulation displacement terminals were developed. However, these terminals had a tendency to cause a point of weakness where the knife like blades cut through the insulation. Subsequent vibration could weaken the terminal to wire connection, or overtightening might completely sever the wire. A telecommunications terminal block with a positive stopping action on a shoulder of the terminal post was disclosed in U.S. Ser. No. 07/270,411 filed Nov. 7, 1988 and also the previously mentioned applications. While overcoming many of the problems of prior art standard post and nut terminals or insulation displacement terminals, the terminal required highly refined tolerances within the cap/post configuration. The test port through the top of the cap provided limited room for the test probe to form an electrical connection. In addition, having a device which separated the test port and cap functions would provide beneficial aspects and advantages readily apparent to the customer. It would also be desirable to have a cap which was captured by the block without the excessive need of a long terminal post requiring a plurality of turns for engagement and disengagement with a further non-threaded section to avoid liftoff.

It would also be desirable to have a terminal block permitting the use of automated connections between the stub wires and the terminal post apart from the labor intensive wiring of the terminal posts. Thus, it would be desirable to have a process which permitted the welding of the stub wire to the base of the terminal in an organized fashion. Additionally, it would be desirable to have a means of forming the electrical contact to the wire while avoiding the stringent requirements of close tolerance machining at the terminal post/cap interface.

SUMMARY OF THE INVENTION

The invention in various combinations of its embodiments provides for at least one if not all the previously recited desirable features as well as other features which would be readily apparent to the ordinary skilled artisan from the following more detailed description. More specifically, the terminal block can form an electrical contact to a plurality of different gauge wire sizes without severing the smallest size while making secure electrical contacts to the largest size. An embodiment of the block's construction provides for a method of manufacture permitting the welding of the base wires to the terminal post base and thus avoiding the need for time consuming wire wrapping.

Additional embodiments and features alone or in conjunction with the other beneficial attributes of the invention include providing a means for capturing the terminal cap so that it is not lost upon disconnection of the cap from the wire and terminal post. A further additional beneficial embodiment is the separation and isolation of the testing of the electrical connection from the terminal cap.

Thus, in an embodiment, the present invention provides a binding post for a terminal block, having:

(a) opening means therein for receiving an insulated wire;

(b) means for receiving a cap which cap has an edge that can cut through insulation of said wire when received in said opening means; and (c) stop means against which said edge (or other part) of said cap can bear thereby limiting receipt of the cap on the post; the opening means and the stop means being positioned relative one another such that when the cap is fully received on the post the edge contacts a conductor of the wire through its insulation at a point where it does not sever the wire.

Close tolerances need therefore be provided only on the binding post (in the relation between opening means and stop means), particularly where it is the cutting edge that bears against the stop means.

The opening means may be a hole of closed cross-section that extends through the post, or it may be a slot. The wire preferably does not bear against the stop means when it is in the opening means since that might cause it to be bent or perhaps severed by the cutting edge. An exception may be when the cutting edge is intended to sever the wire so as to cut it to length, the good electrical connection occurring at a first point and the severing occurring at a second point along the length of the wire. For example the connection could be made at one side of the binding post and excess wire cut away at the opposite side of the binding post.

The opening means preferably comprises a slot having as its cross-sectional shape a sector of a circle, the angle subtended by the sector preferably being at least 180° C., particularly at least 270° C. In this way (and also when the opening means is a hole of closed cross-section) the wire has to be inserted axially, and cannot come out laterally. Also, when the cap is withdrawn at least partially from the binding post, the wire will not be withdrawn with it, and as a result electrical contact between wire and cap may be broken with certainty. This may be useful for testing since, for example, a drop wire at a terminal block can be isolated from a wire on the central office side.

Where the opening means comprises a slot, part of the circumference of the wire will be exposed, and it may be through at least that exposed part that the cutting edge cuts. The opening means may be regarded as breaking through the wall or end of the binding post, and the stop means may comprise an extension of that wall at the break-out point.

In general the stop means will not be present along at least a significant part of the path adjacent the post along which the wire lies. In particular it preferably does not lie along the center line of that path since otherwise the cutting edge is likely to sever the conductor of the wire.

The binding post may have two or more holes (which term includes slots, as mentioned above) so that two (or more) wires may be connected to it and/or so that one (or more) wires of different size may be connected. Where two wires are to be connected, the holes may be so positioned that connection to both is made using a single cap, or they may be for example separated along the length of the binding post such that separate caps are required for each wire. In one embodiment, each end of the binding post can receive a cap, and a hole is provided adjacent each end. In this way, a subscriber drop wire, and a conductor of a distribution cable (or pig-tail conductor to be connected thereto) are each connected by an insulation-displacement cap to the respective ends of the binding post. This provides a further distinction over the prior art, where connection of the cable conductors is by means of wire-wrapping around an end of the post. We prefer that the holes (or hole) for receipt of the cable conductors is a slot (or slots) opening into the lower end of the post, and the hole (or holes) for the subscriber drop wire is through an intermediate portion of the post and is either closed in cross-section, or breaks through a side wall of the post.

More preferably, two holes of different diameter may be provided, preferably mutually parallel, for the drop wires, and/or two different size slots preferably having an angle from 20°-90°, particularly 30°-60°, between them and preferably along diameters of the post may be provided for the cable conductors.

The hole will in general pass through the post perpendicular to its length and as a result all parts of a conductor therein (in most cases the two portions emerging from the side of the post) will be subjected to the same force and displacement by the cutting edge. The range of wire sizes that may be connected may, however, be broadened if the hole is slightly oblique to the length of the post. In particular a slot or slots at the lower end of the post for receipt of the cable conductors may vary in depth along their length. A narrow gauge wire may then be properly contacted by the shallower end of the slot, and a larger gauge wire by the deeper end. Damage may occur to the larger wire at the shallower end of the slot, but it will not matter. The post of the invention is preferably able to connect wire of at least 18 ½ to 24 gauge, particularly 19-24 gauge.

One or more, generally one or more pairs, especially 3, 5, 10, 12, 25 or up to 50 or more pairs of posts may be provided as part of a terminal block. Such a terminal block may additionally comprise an insulating body in which the posts are mounted, which may have holes aligned with the holes in the post. A base, covering the lower ends of the posts, and/or a cover covering the upper ends of the posts may also be provided. A sealing means, generally a material, such as a gel, may be provided to seal the posts and wires and may be trapped between body and cover and/or between body and base. The sealing means will preferably be positioned such that it is penetrated by the wire when received in the opening means. The sealing material may be maintained under compression. A suitable gel is described in U.S. Pat. No. 4,600,261 (Debbaut, assigned to Raychem) the disclosure of which is incorporated herein by reference.

Alternative terminal block embodiments include a base configuration permitting the abutment of the cutting edge cap on the base of the post while having an appropriate indent or cut away portion on a peripheral edge of the base in line with the wire and a broader base section, e.g., perpendicular to the wire axis, to form an electrical contact between the base broader section and the cutting edge without severing the wire. This base post member design additionally permits the optimizing of various cutting edges of the terminal post/base combination for particular wire sizes. The base configuration avoids the need for a multiplicity of ports or separate cutting edges to make electrical contacts to wires ranging from 24 gauge through 19 gauge.

DETAILED DESCRIPTION OF THE INVENTION

The invention and its various embodiments will be more clearly illustrated by referring to the attached drawings. Although the drawings will be discussed substantially in sequence, reviewing the drawings in conjunction with each other will provide an overall view of the interaction of the components.

Figure 1:
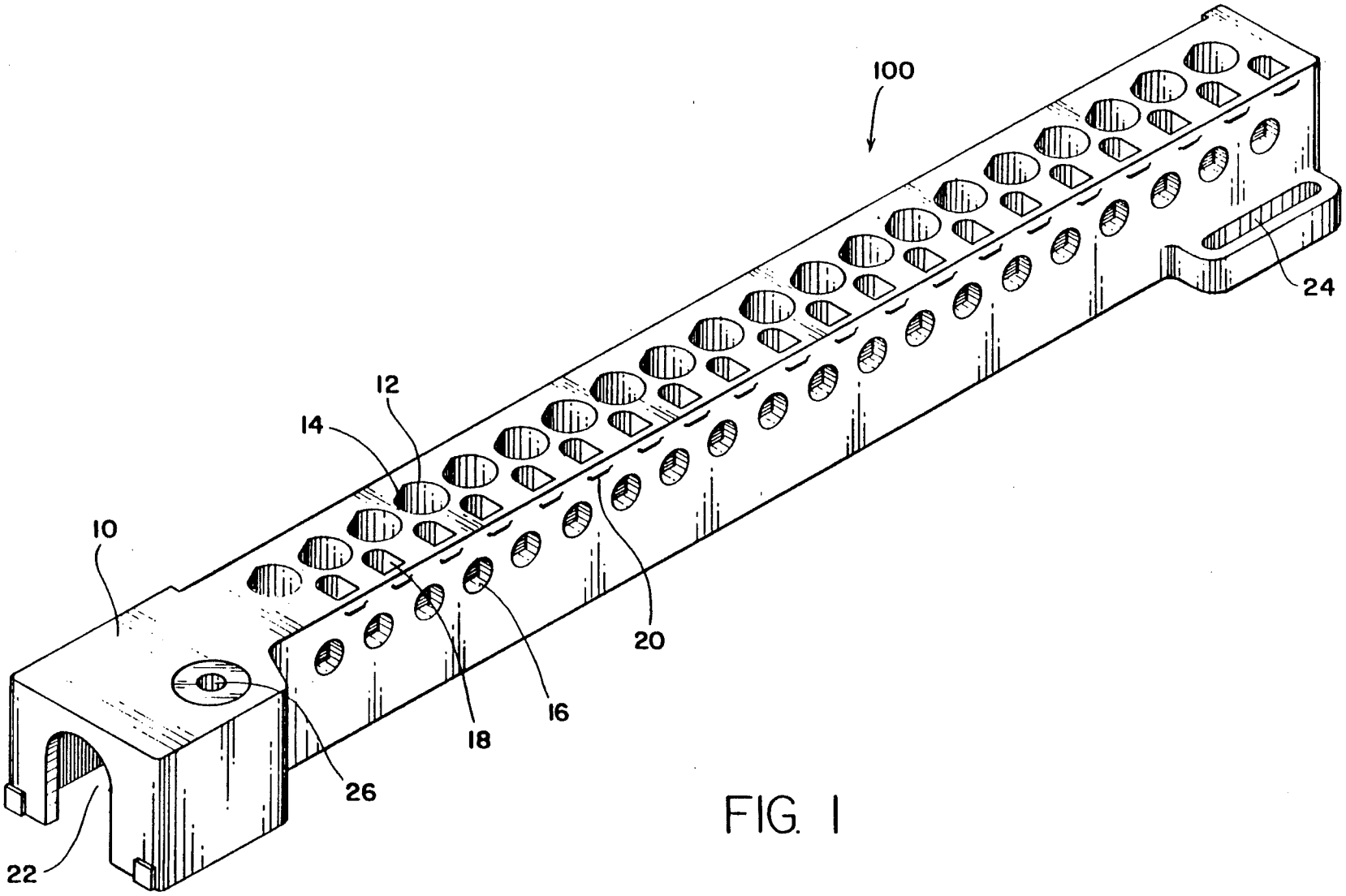
FIG. 1 illustrates an oblique view of a 10-pair terminal block without posts, caps, or terminal stub wire.
Figure 2:
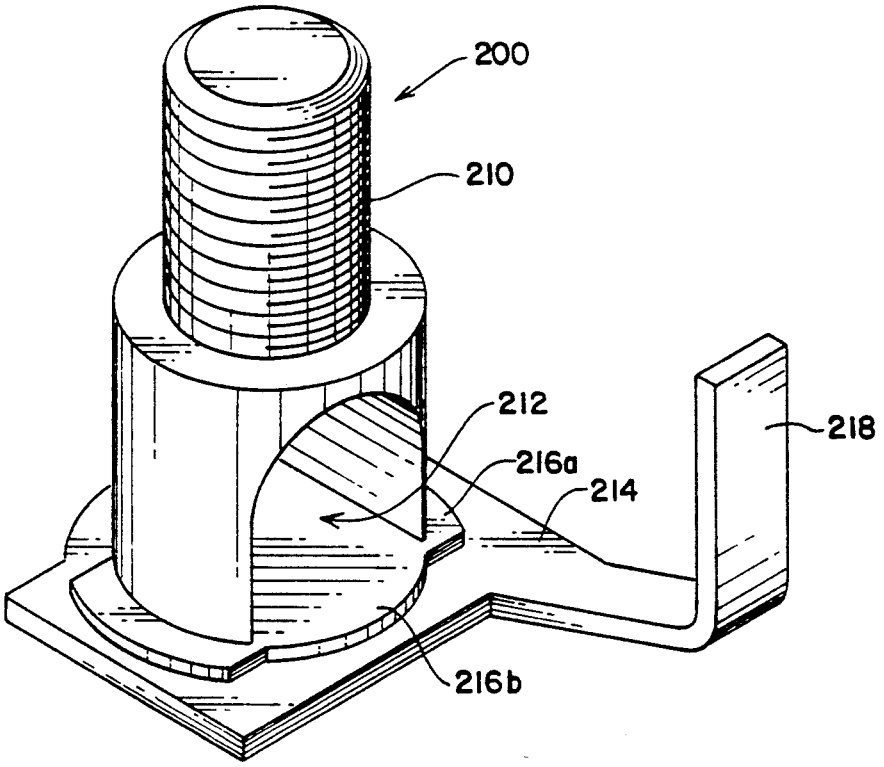
FIG. 2 illustrates a base terminal/post combination for the block of FIG. 1.
Figures 12A, 12B:
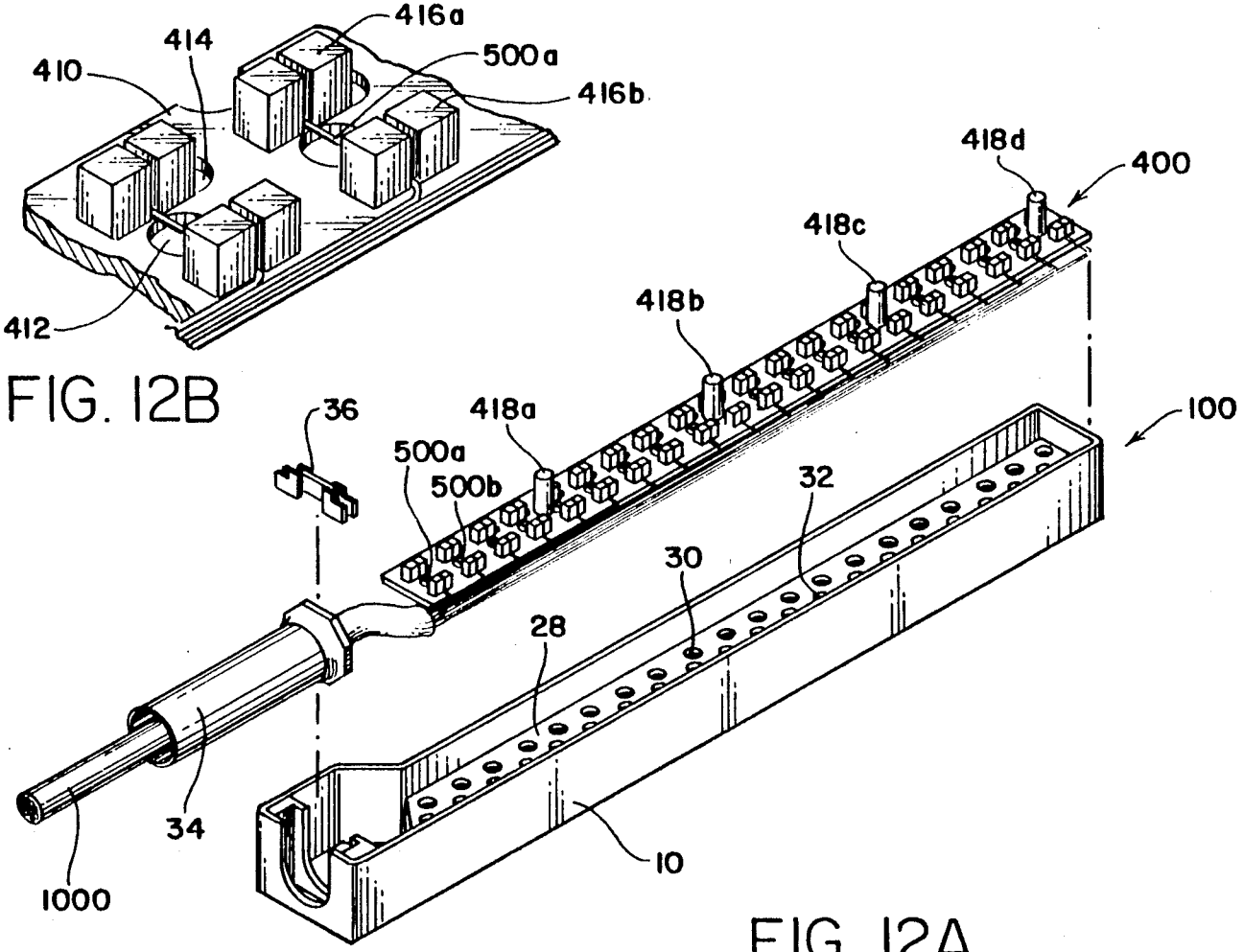
FIGS. 12*a* and 12*b* illustrate the underside of the block in FIG. 1 including the wire preform which permits the welding contact of the post wires to the base of a terminal post.

FIG. 1 illustrates a terminal block 100 without the posts 200 (FIG. 2), the cap 300 (FIG. 3), or the electrical cable 1000 contacting the posts (FIG. 12). More specifically, the block 100 has a base member 10 with a plurality of post apertures 12. Preferably the base member is fabricated from UV stable glass filled polyester such as Valox 508. The post apertures 12 are substantially circular in shape with a flat side 14 to create the captured cap embodiment of the invention. This retention embodiment prevents the cap from falling out of the block when the cap is disengaged from the post. Initially, the cap is installed into the aperture and snap fit therein onto the binding post.

The apertures 12 are in communication with the apertures 16 in to which the drop wires are inserted. The aperture 16 is preferably sized to accept the plurality of wires from about 24 gauge or smaller up through about 19 gauge or larger. The optional embodiment aperture 18 preferably not in communication with apertures 12 or 16 houses a portion of the post to which an electrical contact can be made to test the continuity of the electrical circuit. On the face of the block 10 having the apertures 16 is a retention or ridge like member 20 to assist the clipping of an electrical test probe, not illustrated, to the electrical connection test post located within the aperture 18. The block further includes a port 22 designed to accept the terminal base cable therein. Slot 24 and ground contact hole 26 permit the mounting of the block 100. If the cabinet or mounting hardware is particularly sized for the block then slot 24 can be a single hole. The hole 26 is electrically connected to the grounding base plate by a standard bolt.

Within each aperture 12 and 18 is a post assembly 200. The post assembly 200 includes a threaded portion 210 for the cap of the terminal block. The post 200 further includes an aperture 212 substantial coincident in the block 100 to accept the various size gauges of wire for electrical connection. The post assembly 200 further includes a base member 214 optionally having an arm 218 which fits within aperture 18 in the block 10 to which electrical test probes can be connected. The post assembly 200 is preferably molded within the base so that the test port arm 218 is not in open communication with the apertures 12 and 16. The sealing of the test port arm 218 allows different gel fill levels in each aperture and also to prevent corrosion of the drop wire in the event that the test port gel fails.

Figure 3:
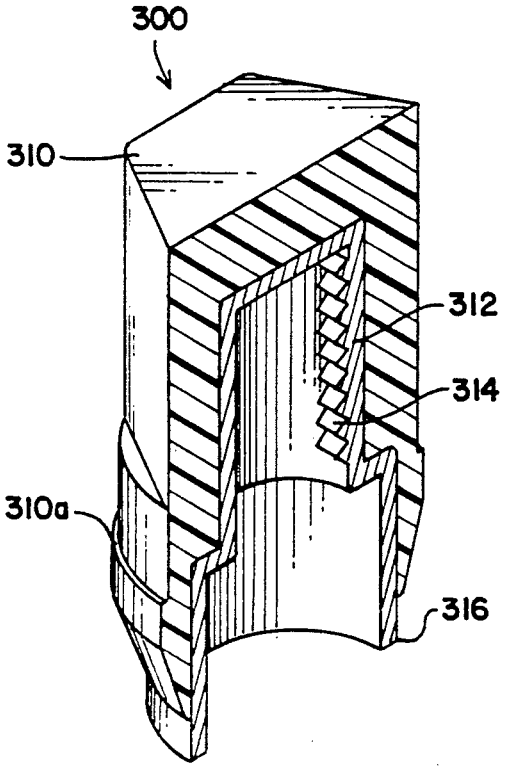
FIG. 3 illustrates an oblique cross-sectional view of the cap for the post terminal block combination of FIGS. 1 and 2.

The base member 214 further includes an outer peripheral shoulder **216*a* on which the cutting edge 316 of the cap, see FIG. 3, contacts upon tightening of the cap on the threaded post 210. The cutaway portion of the base member 216*b* is sized so that when the cap edge 316 contacts the shoulder 216*a***, the smallest dimension of wire is not severed and is also contacted at opposite locations across its diameter to form a metal cap to metal wire to metal base contact, i.e., a secure metal-to-metal-to-metal contact.

The cutaway **216*b* need not be symmetrical. In a preferred embodiment, the cutaway portion has a different circumference on the front as illustrated than on the back, not illustrated, to accept different sizes of wire without severing the wire when the cap edge 316 grounds out on the base member 216*a*. Although parts 216 and 214 can be fabricated of different materials and welded together, in the preferred embodiment, the raised portions are made from a single piece of material which has been appropriately coined or stamped to achieve the desired shape. Any suitable stamping operation known in the art is acceptable to achieve the results of the invention. The post assembly 210 can be soldered, welded, mechanically swaged or otherwise affixed to the base member 214**. Of course, the complete assembly could be machined out of a single block of material but this is a less preferred embodiment because of cost considerations. The cap insert, post base, and post-stirrup are preferably fabricated from 510 phosphor bronze, 510 phosphor bronze, and 655 si bronze or 647 modified spinoidal alloy with a post heat treatment, respectively.

The binding post-stirrup is preferably made from a cold headed rod form and forged in a series of dies starting from a metal slug followed by projection forming then extruding with qualify finishing. The base is formed in a progressive die arrangement with coining, hole piercing, blank shaping, and finally the stirrup will be inserted into the base post base forming tool. The projections from the base of the post stirrup will then be swaged, soldered, welded (electrical, gas, or ultrasonic) and the like to provide a mechanical and electrical connection between the parts. This assembly operation is preferably done in a progressive process for reduced cost.

FIG. 3 illustrates a preferred cap 300 according to the invention. The cap 300 includes a plastic body 310 molded around a metallic insert 312 having threads thereon 314. The metallic insert 312 further includes the cutting edge 316 as illustrated. The threaded portion 314 is sized to engage the threads 210 on the post assembly 200. The threaded portion 314 of the cap 312 can be fabricated by machining or preferably by coining as performed by the Truelove McLean Company of Waterbury, Conn. Any means known in the art for forming the threads 314 and cutting edge 316 are suitable for use in the invention. The plastic insert 310 further includes an outer edge **310*a* which will be captured in the block by edge 14 to preclude the cap from falling out when disconnected from the post 210 in the absence of the specific intent of the crafts person to remove the cap from post assembly 200 and the aperture 12**.

Figure 4B:
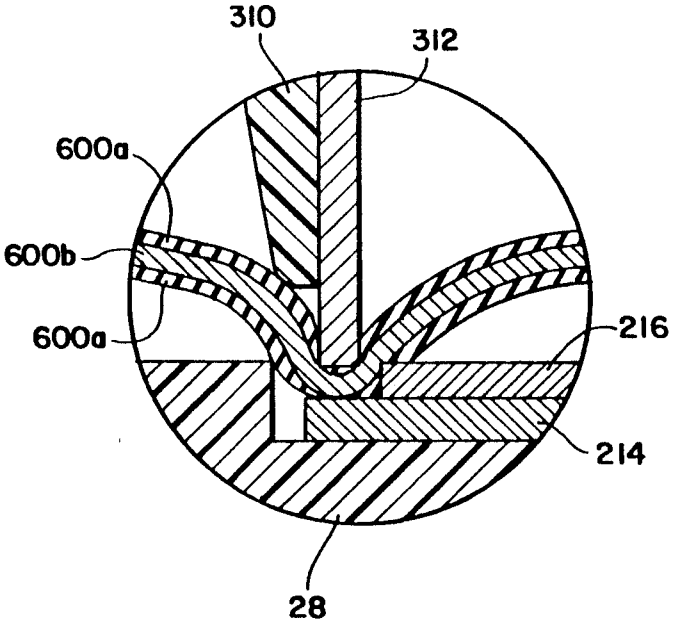
FIGS. 4*a*, and 4*b* illustrate a more detailed view of the cap in combination with the terminal post.
Figure 4A:
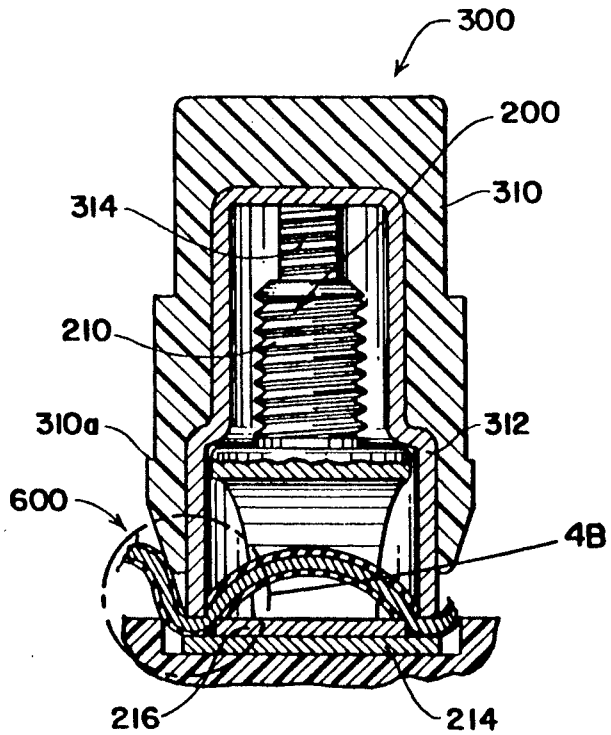

FIG. 4 and the insert illustrates the cap 300 on post 200 with the strain relief cutting action of the cap edge 316 into the wire 600 having insulation **600*a* and a metal core 600*b*. In reference to the coining of the base member 216*b* in FIG. 2, the edge can have a different circumference on the right hand side of FIG. 4 to the left hand side of FIG. 4** to optimize electrical connection to different sizes of drop wires.

Figure 5A:
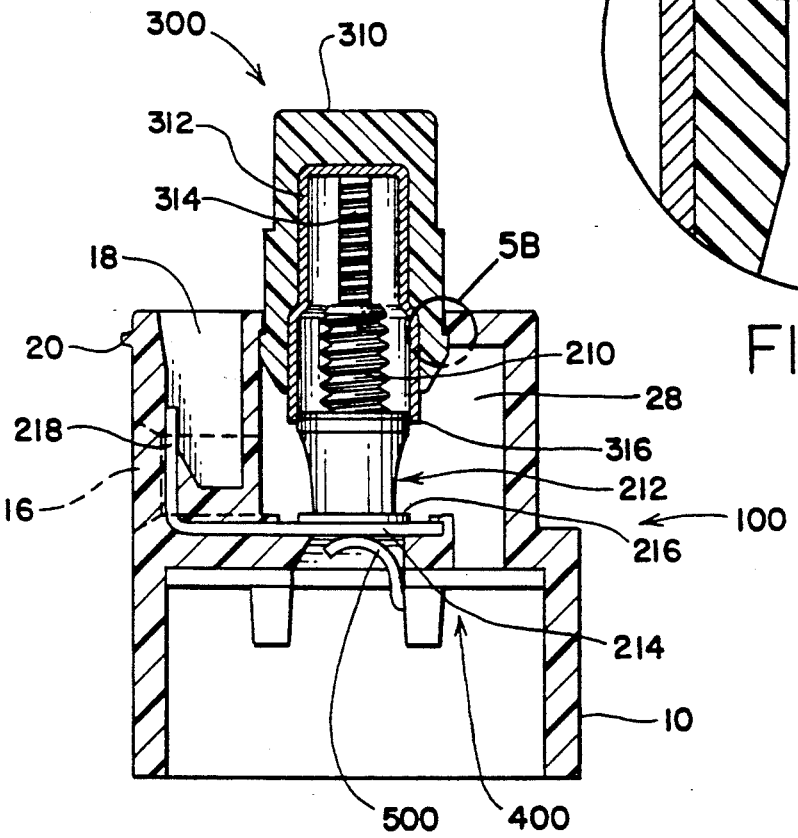
FIGS. 5*a* and 5*b* illustrate a cross-sectional view of the cap/post terminal block combination highlighting the separate test port feature and the captured cap feature.
Figure 5B:
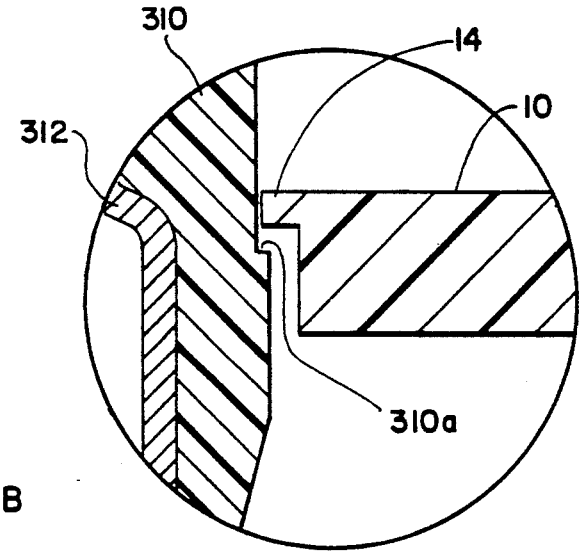

FIG. 5 is a cross-sectional view of the block 100 with post assembly 200 molded therein and the cap assembly 300. The detail of the captured cap figure is illustrated in the exploded portion view showing the top of the block 10 with the molded flat edge 14 and the ridge **310*a* on the cap assembly 300. Also illustrated in FIG. 5 is aperture 18 having the electrical test contact 218 therein. The apertures 12, 16, and 18** are preferably filled with a gel or other suitable sealing material. Suitable preferred gels are described in U.S. Pat. Nos. 4,634,207; 4,600,261; and 4,864,725 incorporated herein by reference for all purposes. Suitable gels have a cone penetration of from about 75 to 350 ($10^{-1}$ mm) with an ultimate elongation of at least 100% preferably 100 to 250 ($10^{-1}$ mm) with an elongation of at least about 200% at either cone penetration range. In environments where more moisture sealing is not a problem, the block need not be filled with gel.

FIGS. **6*a* and 6*b* show a binding post 613 having a threaded portion 618 over which a cap 300 (see FIG. 3) may be screwed in order to make contact with a wire introduced into opening 615. The post of FIGS. 6*a* and 6*b* has a second threaded portion 622 and a second opening means 620, here shown as a slot. Thus, instead of a conductor from a cable being conventionally wire wrapped, it may be secured by placing it in slot 620 and applying a cap to threaded portion 622. That cap may have insulation displacement means (for example a circumferential cutting edge as in the cap 300 of FIG. 3) thereby avoiding the need to strip the conductor from the cable. The opening means 620 is preferably a slot in order that a conductor may be inserted laterally. Such lateral insertion might be desirable where the wires from the conductor are of very light gauge and likely to bend if pushed axially, especially through a sealant material such as a gel which may surround the posts. Drop wires to be connected to the top part of the posts are often thicker and can be easily inserted axially into hole 615. Also, there is less benefit in the holes 620** being of closed cross-section since frequent making and breaking of the electrical connection between the cable and the post is unlikely to be desired. A hole of substantially closed cross-section is preferred where making and breaking is frequent since the wire is retained better, allowing mere backing-off of the cap to break the connection. This can be done without the wire becoming mechanically freed or, alternatively, sticking to the cap as it is backed-off, and thus preventing breaking of the electrical connection.

Figure 6A:
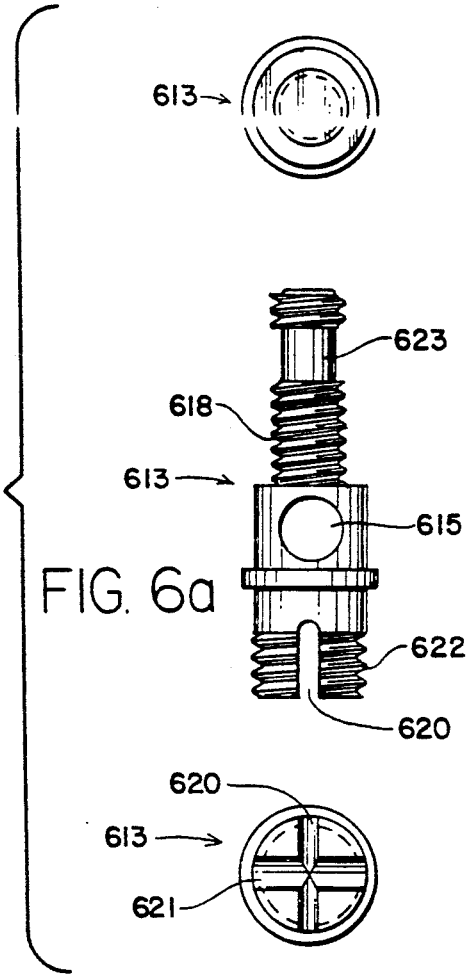
FIGS. 6*a* and 6*b* show an alternative binding post embodiment of the invention.
Figure 6B:
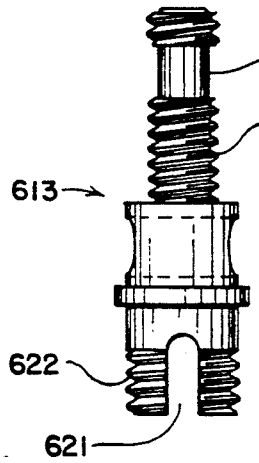

The post 613 illustrated in FIGS. 6*a* and 6*b* has two openings in its base, 620, 621, for two different wire sizes. These two openings are shown at 90° C. to one another, but other angular separations, such as about 45°, may be preferred so that the wire leaves the post in approximately the same direction irrespective of which hole 620, 621 is selected.

Preferably the caps for the threads 618 and 622 are substantially the same, or otherwise are such that the same tool (generally a so-called can wrench) can be used on each.

A portion of thread may be omitted, as shown at 623, in order that the cap on thread 618 be difficult to remove accidentally. This is an alternative to edge 14 in block 10 of FIG. 1. As shown a cap would have to be deliberately lifted while being turned for it to engage the top few threads.

The posts are preferably from 1.5 to 5, especially 2–4 cms tall, and of substantially similar shape to that illustrated.

The posts of FIGS. 6*a* and 6*b* may be used in a block similar to that illustrated in FIG. 1 or the EPC application, and with caps similar to those shown in FIG. 3 or the EPC application, although other designs may be chosen. For example the cap need not be hollow.

Figure 7A:
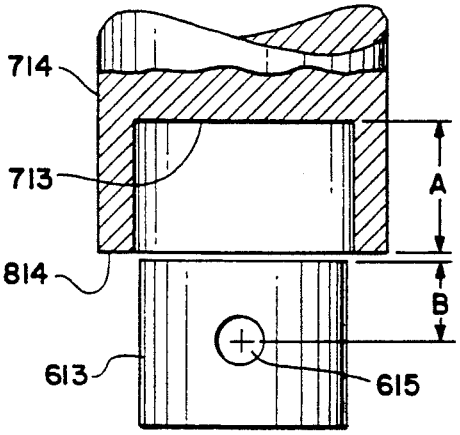
FIG. 7a PRIOR ART
FIGS. 7*a* and 7*b* compare a prior art binding post and cap and the embodiments of FIGS. 6*a* and 6*b*.
Figure 7B:
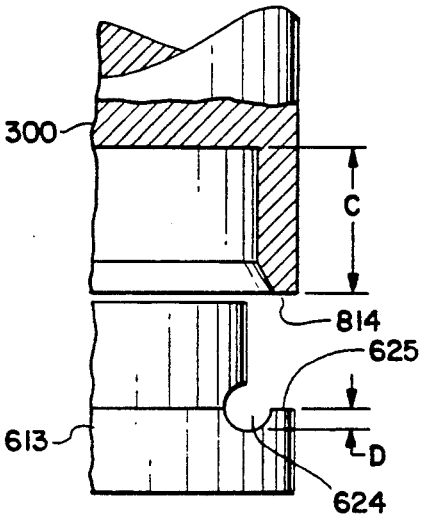

FIGS. 7*a* and 7*b* are simplified illustrations of a part of a post 613 and a cap 300/714, FIG. 7*a* illustrating the prior art and FIG. 7*b* an embodiment of the invention.

The features of FIG. 7*b* may be used with or without those of FIGS. 6*a* and 6*b*.

In FIG. 7*a* the tolerances of dimensions A and B are critical if stop means 713 is to prevent cutting edge 814 advancing too far when the cap 300/714 is screwed onto the post 613. It is necessary that cutting edge 814 advance sufficiently for it to cut through insulation of a wire (not shown) placed in opening 615 for electrical contact to be made to its internal conductor; but it is also important that the wire remain unsevered.

Close tolerances in the design of the cap may be avoided with the invention, as shown in FIG. 7*b*, where dimension C does not affect the extent to which the cap can safely be advanced.

Here the stop means is a shoulder 625 against which the cutting edge 814 directly bears. The only critical dimension in this regard is dimension D.

The opening for the wire may be closed in cross-section or it may comprise a slot 624, as drawn. The slot 624 can be seen to break through a side wall of the post 613, and the stop means 625 comprises a surface adjacent the break-through, preferably an extension of the wall at the breakout point as shown.

Figure 8:
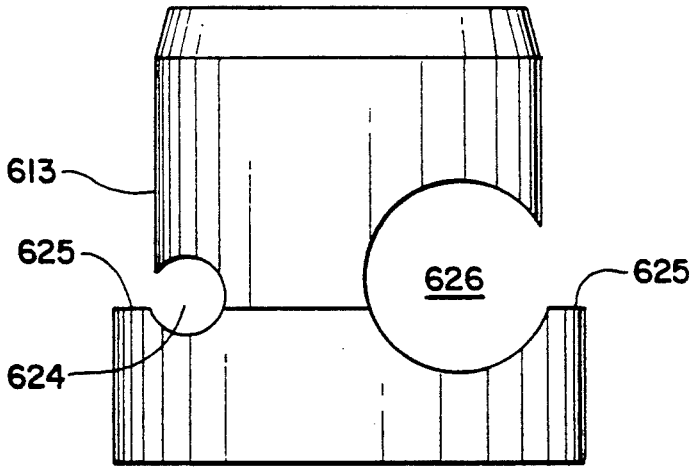
FIG. 8 shows part of an inventive post embodiment.

FIG. 8 shows a post 613 with two slots 624 and 626 of different sizes, for accommodation of drop wires of various size.

Figure 9:
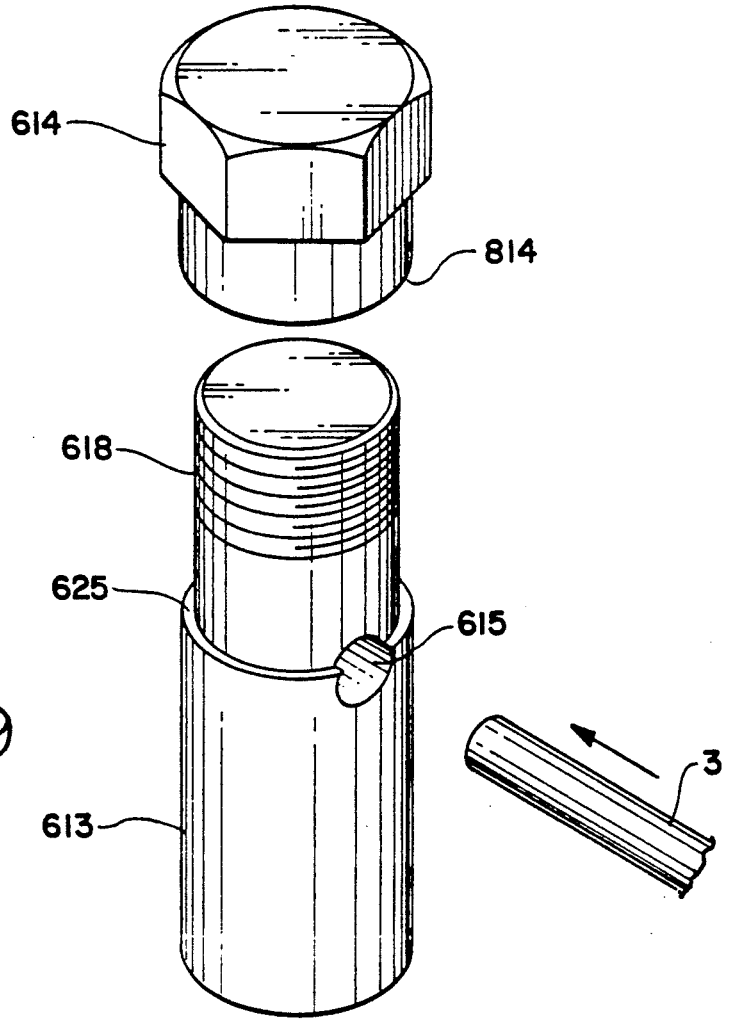
FIGS. 9 and 10 show further alternative embodiments to the design embodiment of FIG. 8.

FIG. 9 shows an alternative design where the opening means comprises a hole 615 of closed cross-section, and the stop means comprises an annular edge 625. The stop means need not extend all around the post and may instead comprise a localized extension from a generally cylindrical surface of the post proper. It will in general be aligned adjacent, generally a little above as drawn, a center line through the hole 615, since the conductor 3 which should not be severed will lie on that center line. The cutting edge 814 of cap 614 bottoms on edge 625.

Figure 10:
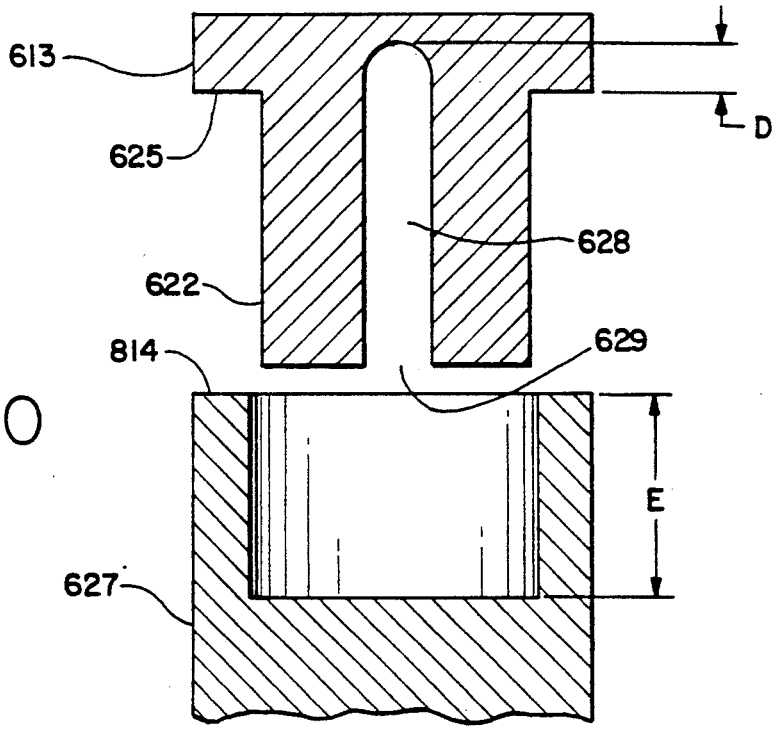

FIG. 10 shows part of a lower part of a post 613 having a slot 628 for receiving a wire from a cable, and a cap 627 ready to be received on the post 613. The slot 628 can be seen to break out into an end 629 of the post. Here the dimension D is critical, but dimension E may vary. Cutting edge 814 of cap 627 will abut stop means 625 to prevent severing of a wire placed in slot 628.

Figure 11:
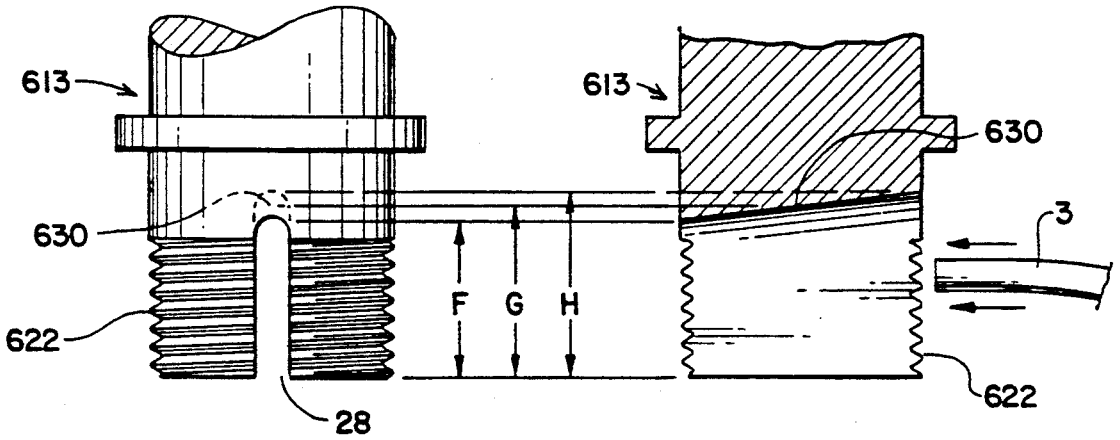
FIG. 11 illustrates a way of increasing the range of wire sizes acceptable by a post.

FIG. 11 shows a variation to the post 613 shown in FIG. 10. Here the slot 628 is tapered at its blind end so that its depth varies as shown at 630. Thus, when a cap is screwed over threads 622 it will be able to contact, but will not unduly damage, wires 3 of a variety of diameters. In this way a single slot can be used in place of the two slots of FIG. 6*a* and 6*b*. The values of dimensions F, G, and H are chosen such that (H−F) guarantees a good contact to a larger wire, for example 0.9 mm diameter, on the right-hand side of the post as drawn. The consequential value of (G−F) may lead to some cutting or complete severing of the conductor of the wire on the left-hand side, but this will not matter. Smaller wires, say 0.4 mm diameter will be properly connected due to the chosen value of (G−F).

Figure 13:
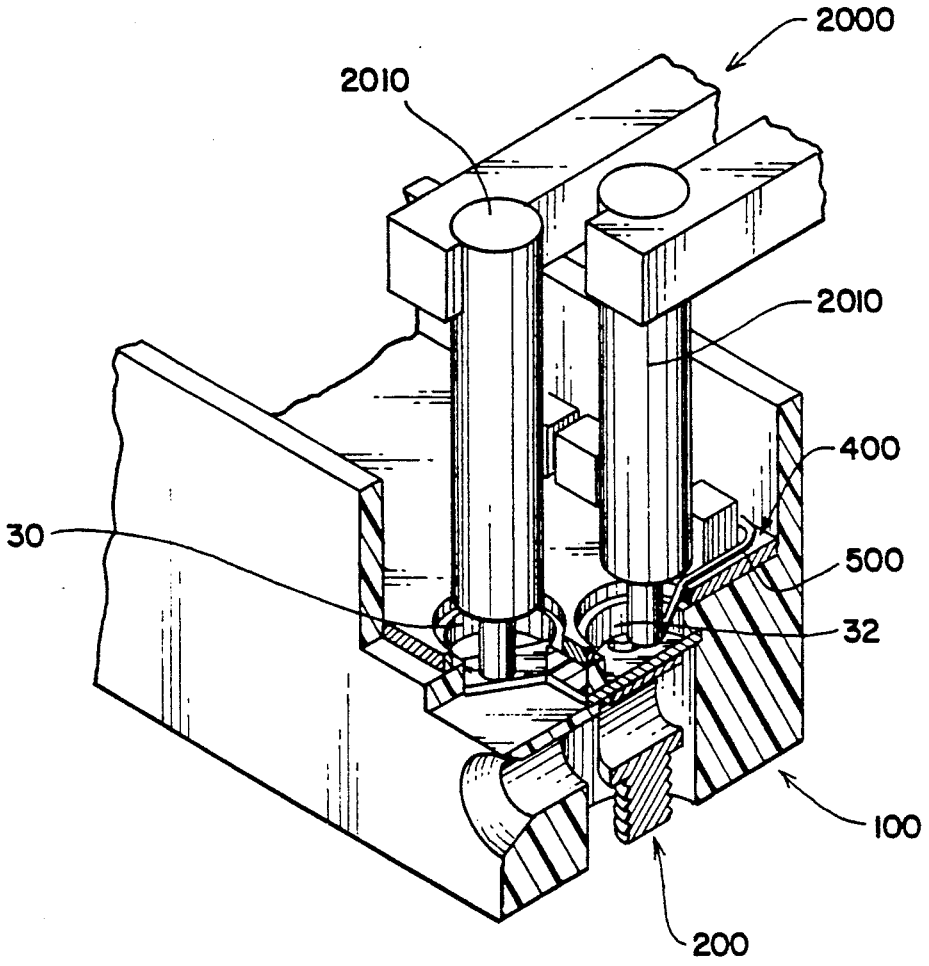
FIG. 13 illustrates a welding apparatus securing the wires to the base post.

FIGS. 12 and 13 illustrate an automated method embodiment of manufacturing the block by utilizing a preform 400 for taking the individual wires from the cable 1000 and organizing them as illustrated in FIG. 12 for subsequent welding by welding machine 2000. The welding machine 2000 has a electrodes 2010 and 2012 to weld wires 500*a*, 500*b*, etc. located within preform 400 between wire positioners 416*a* and 416*b*. The preform has a body 410 which includes apertures 412 and 414 to permit the contacting and welding of the wire 500*a*, 500*b*, etc. Elements 418*a, b, c*, etc. are mold injection points for the plastic preform 400 and also serve as pressuring points to retain the preform 400 within the block 10 prior to sealing by potting with any suitable potting compound or other suitable means. In operation, one electrode 2010 grounds out in the base of the base plate 214 through aperture 414 in the form 400 while the other electrode 2012 drives the wire 500*a* or 500*b*, etc. out of the wire positioner 416*a* or 416*b*, etc. and through aperture 412 to contact the base 214, complete the circuit and weld the wire thereto.

The preform further includes a strain relief shielding member 34 which inserts into the block 100 base member 10 with blocking member 36 to retain the cable 1000 and wires within the preform 400 in the block 10.

Having described the invention with reference to particularly preferred embodiments, modifications which would be obvious to the ordinary skilled artisan are contemplated to be within the scope of the invention. For the avoidance of doubt it is noted that the invention provides articles and methods for electrical connection particularly of telecommunications cables to drop wires. Any one or more of the designs of posts, caps, terminal blocks and insulation displacement means disclosed herein may be chosen.

We claim:

1. A terminal apparatus comprising:

a housing, said housing having first and second apertures in communication with and substantially perpendicular to one another:

a threaded binding post within said housing and within said first aperture, said binding post having an opening within its base, said opening being in communication with said second aperture and capable of receiving wires of varying gauge sizes;

a binding post cap having an outer insulative portion and an inner conductive portion, said inner conductive portion having a cutting edge capable of piercing the insulation on a wire, and having an interior portion capable of threadedly engaging said binding post;

a broadened portion on said post having edges capable of engaging the cutting edge of said cap, said portion having means adjoining said opening within said binding post sized for accepting the minimum diameter of wire to be inserted into the binding post without severing the wire when the cap is threadedly engaged on the binding post with said broadened portion engaging said cutting edge; and means within the housing for retaining said binding post cap within the housing when said binding post cap is not in contact with the binding post broadened portion or such a wire.

2. The apparatus according to claim 1 wherein the means for retaining the binding post cap is a squared corner of a circular first aperture.

3. The apparatus according to claim 2 wherein the binding post and first and second aperture constitute a unit, and further comprising a plurality of such units to connect to a plurality of wires.

4. The apparatus according to claim 3 wherein each first and second aperture pair includes a third aperture not in communication with said first and second apertures but paired therewith, said third aperture including a conductive metallic portion in contact with said base of said binding post.

5. The apparatus according to claim 4 wherein the first, second, and third apertures are filled with a gel.

6. A binding post for a terminal block, having (a) opening means therein for receiving an insulated wire;

(b) means for receiving a cap which cap has an edge that can cut through insulation of said wire when received in said opening means;

(c) stop means against which said edge of said cap can bear thereby limiting receipt of the cap on the post;

the opening means and the stop means being positioned relative one another such that when the cap is fully received on the post the edge contacts a conductor of the wire through its insulation at a point where it does not sever the wire, the stop means is between a metallic cap cutting edge and a broadened base portion of the terminal post.

7. A post according to claim 6 in which the opening means comprises a slot that breaks through a side wall of the post.

8. A post according to claim 7 in which the stop means comprises a surface adjacent the break-through.

9. A post according to claim 8 having at least two opening means for receipt of different size wires, said cap being able to cut through insulation of each of said wires.

10. A post according to claim 9 having said means for receiving adjacent one end thereof and having adjacent another end thereof a second means for receiving and a second opening means.

11. A terminal block having a post according to claim 10.

12. A post according to claim 10 in which said second means comprises a slot that breaks through an end wall of the post.

13. A post according to claim 12 in which the stop means comprises a substantially annular shoulder aligned adjacent a center line through said opening means.

14. An assembly which comprises a post according to claim 13 and said cap.

15. An assembly according to claim 14 in which the cutting edge comprises an annular projection.

16. A terminal block having a post according to claim 6.

17. A terminal block according to claim 16 having environmental sealing means.

18. A terminal block according to claim 17 in which the sealing means comprises a gel.

19. A terminal block according to claim 18 in which the sealing means is positioned such that it is penetrated by the wire when received in the opening means.

* * * * *